United States Patent [19]

Dow

[11] 4,106,574

[45] Aug. 15, 1978

[54] METHOD FOR ESTABLISHING HIGH PERMEABILITY FLOW PATH BETWEEN BOREHOLES

[75] Inventor: Jerome P. Dow, Pleasanton, Calif.

[73] Assignee: The United States of America as represented by the United States Department of Energy, Washington, D.C.

[21] Appl. No.: 813,551

[22] Filed: Jul. 7, 1977

[51] Int. Cl.[2] ..... E21B 7/00; E21B 43/26

[52] U.S. Cl. ..... 175/4.57; 166/271

[58] Field of Search ..... 175/4.5, 4.51, 4.57, 175/3.5; 166/271, 63; 299/13

[56] References Cited

U.S. PATENT DOCUMENTS

| | | | |
|---|---|---|---|
| 2,630,182 | 3/1953 | Klotz, Jr. | 166/271 |
| 2,837,027 | 6/1958 | Martin | 175/4.6 |
| 3,216,320 | 11/1965 | Thomas et al. | 175/4.6 |
| 3,627,044 | 12/1971 | Dunlap | 166/271 |
| 3,708,013 | 1/1973 | Dismukes | 166/276 |
| 4,018,293 | 4/1977 | Keller | 175/4.6 |

*Primary Examiner*—James A. Leppink

*Attorney, Agent, or Firm*—Dean E. Carlson; Roger S. Gaither; Irene S. Croft

[57] ABSTRACT

A method for linking adjacent boreholes in a subterranean formation, particularly in a coal gasification array, by firing a high velocity terradynamic projectile from one borehole to the other.

6 Claims, 4 Drawing Figures

METHOD FOR ESTABLISHING HIGH PERMEABILITY FLOW PATH BETWEEN BOREHOLES

BACKGROUND OF THE INVENTION

This invention was made at the Lawrence Livermore Laboratory under contract W-7405-ENG-48 between the U.S. Energy Research and Development Administration and the University of California.

This invention relates to a method for establishing a flow path between boreholes, particularly in a coal formation for the practice of an in situ coal gasification process.

Much of the coal in the United States occurs in seams extending underground for miles in the horizontal direction. This type of coal formation is most easily gasified in situ by driving a flame front horizontally through the seam between adjacent vertically drilled boreholes. A key factor in the success of such a horizontal gasification technique is that the boreholes must first be interconnected by a high permeability flow path through the coal seam. This is necessary for several reasons: (1) for supplying reactant gases to the flame front, (2) for preventing undesirable channeling of the flame front, (3) for preventing plugging of the seam with tars created by coal pyrolysis, and (4) for withdrawing product gases from the coal seam. Various methods have been proposed for linking boreholes via a high permeability flow path, for example, hydraulic fracturing, reverse combustion, passage of electrical current through the intervening coal, and the like. The limitation of all such linking schemes is that the direction of the linking flow path cannot be controlled. Thus, for example, in hydraulic fracturing the injection of high pressure fluid causes the formation to crack in all directions from the injection point. There is no guarantee that the fractures will occur in the desired direction between boreholes. Similar considerations apply to the other conventional linking techniques.

SUMMARY OF THE INVENTION

The present invention is a method for linking boreholes in a subterranean formation with a high permeability flow path the direction of which can be readily selected and controlled. In accordance with the present invention, a flow path between a first borehole and a second borehole is established by firing a high velocity earth penetrating projectile from the first borehole to the second borehole at a preselected depth.

In a particular embodiment of the invention, a device for firing two projectiles in opposite directions is utilized to link a series of boreholes.

The present invention is particularly suitable for establishing communication between adjacent boreholes in a coal formation for practice of an in situ coal gasification process.

It is, therefore, an object of this invention to provide a method for establishing communication between boreholes in a subterranean formation.

It is a particular object of this invention to provide a method for establishing a high permeability flow path between adjacent boreholes in a coal gasification array.

Other objects and advantages will become apparent from the following detailed description made with reference to the accompanying drawings.

DETAILED DESCRIPTION OF THE INVENTION

Broadly, the present method for linking adjacent boreholes in a subterranean formation comprises emplacing in a first borehole at a preselected depth a means for rapid penetration of terrestrial materials. The rapid penetration means is then suitably oriented so as to cause rapid penetration of the formation along a preselected path in the direction of the second borehole. A high permeability flow path is then created by causing rapid penetration of the formation substantially along the preselected pathway.

The art of rapid penetration of terrestrial materials is generally referred to as terradynamics. Background references in this field include the Sandia Laboratories report SC-DR-72 0523, "Empirical Equations for Predicting Penetration Performance in Layered Earth Materials for Complex Penetrator Configuration", C. W. Young, December 1972, available from the National Technical Information Service, U.S. Department of Commerce, Springfield, Virginia 22161, and *Rapid Penetration of Terrestrial Materials,* John L. Colp, Ed. Proceedings of a Conference Held at Texas A & M University on Feb. 1, 2, 3, 1972.

The term rapid penetration is used in the art to refer to continuous penetration at appreciable velocity, as opposed to slow penetration methods such as drilling. The means for accomplishing such rapid penetration generally comprises an earth penetrating projectile, referred to in the art as a terradynamic projectile, and a suitable delivery means for achieving a high impact velocity. For the purposes of the present invention, an impact velocity of at least 1000 feet per second will generally be required. A typical terradynamic projectile comprises a nose section, generally conic in shape, attached to a generally cylindrical afterbody section. A gun type of device is used for firing the projectile into the earth at the desired velocity.

In a particular embodiment of the invention, a device such as a Davis gun is used to fire two projectiles in opposite directions to interconnect a series of these vertical shafts.

Figure 1:
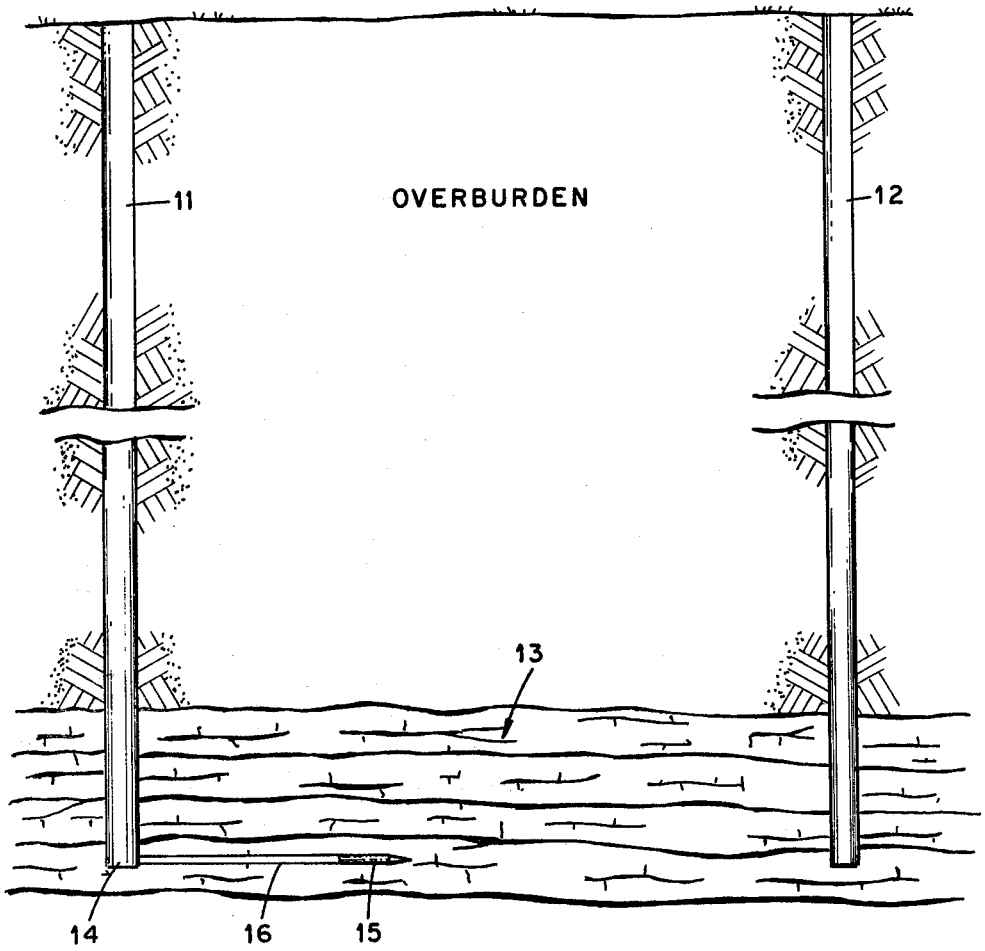
FIG. 1 is a vertical section of a coal seam with two boreholes and illustrating the method of the present invention.
Figure 2:
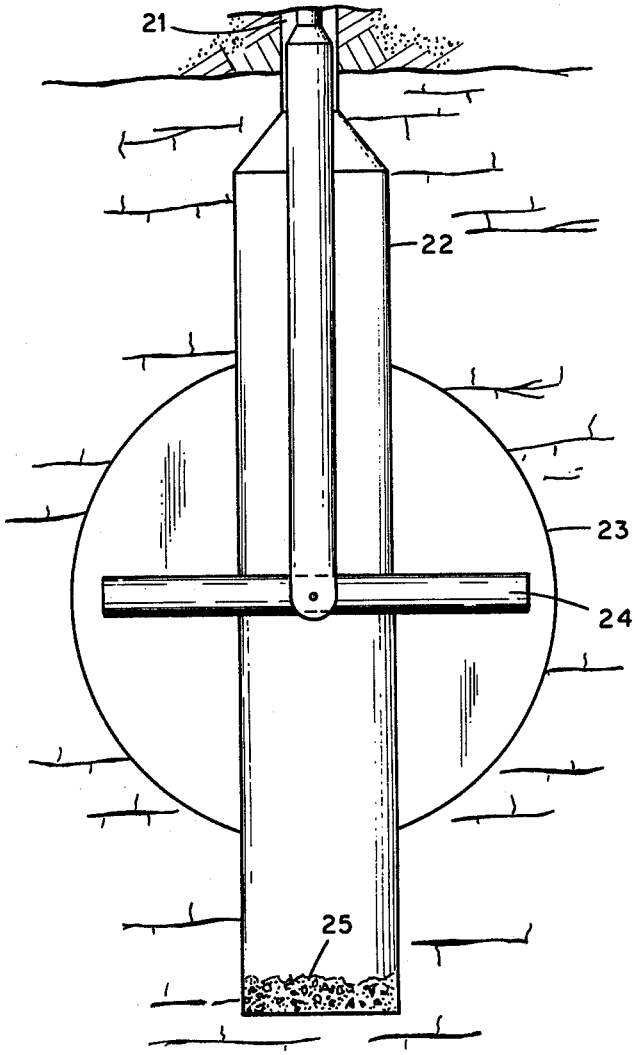
FIG. 2 is a diagrammatic vertical section of a borehole adapted for emplacement of an earth penetrating gun in accordance with a particular embodiment of the present invention.

The process of the present invention is illustrated schematically in FIG. 1 wherein numerals 11 and 12 refer to two boreholes drilled vertically into coal seam 13. An earth penetrating gun is placed in borehole 11 at location 14 and aimed at borehole 12. The gun is then fired and projectile 15 rapidly penetrates the formation creating a generally horizontal linking flow path 16. The hole made by the penetrator is essentially open with only some loose rubble in the hole. The penetrator may deviate from a straight path by as much as about 5% of the path length so that the penetrator hole does not terminate in exactly the desired location at the second borehole but to within a few feet of the desired location. In this case, a small charge of high explosives can be used to loosen the material at the terminus of the penetrator hole and thus create a path for gases to pass from one shaft to the other. p A suitable method for gun emplacement down the borehole is shown schematically in FIG. 2. A vertical shaft 21 is enlarged by underreaming at the desired location as represented by numeral 22. A vertical slot 23 having a diameter sufficient to accommodate the gun barrel being used is then cut into the underreamed portion of the shaft by means known to those skilled in the art, for example, by using a cutter similar to a chain saw. The cuttings 25 accumulate on the bottom of the shaft. Gun 24 is lowered into the shaft into the vertical slot and then rotated into a horizontal position. For example, a 12 inch diameter shaft is underreamed to 36 inches at the desired location. A vertical slot about 9 feet in diameter and 10 inches wide is suitably cut into the underreamed portion for the desired positioning of a gun tube about 8 feet long.

The path length of penetration of the projectile is given by the equation:

$$D = 0.0031\ KSN\sqrt{W/A}\ (V - 100),$$

where $D$ = Penetration path length, usually referred to as depth, ft.

$K$ = Weight scale factor (for W $\geqq$ 60 lbs., K = 1)

$S$ = Index of penetrability

N = Nose performance coefficient $W$ = Penetrator weight, lbs.

$A$ = Penetrator cross sectional area, in$^2$ $V$ = Impact velocity, fps.

As the equation implies, any desired penetration distance can be obtained by increasing the impact velocity. However, at velocities above about 2200 fps the structural integrity of the penetrator becomes marginal. Furthermore, very high velocities are difficult to obtain with the limitations placed on gun barrel length by borehole emplacement.

Figure 3:
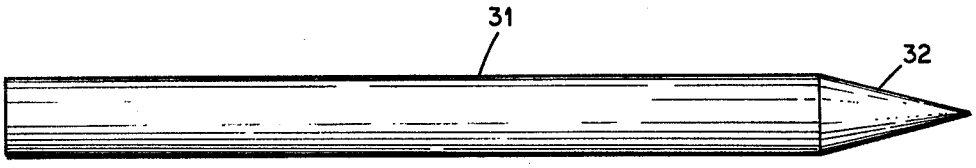
FIG. 3 is a suitable projectile configuration for use in the present invention.

A near optimum penetrator configuration for use in the process of the present invention is shown in FIG. 3 where numeral 31 represents a cylindrical body section and numeral 32 represents a conic nose section. Typical specifications for the penetrator are: total length — 33 inches, length of nose section — 6 inches, diameter of afterbody — 3 inches, material — D6AC steel, and weight — 60 pounds.

Considering the penetrator shown in FIG. 3 and a formation having, for example, an index of penetrability of 3, the penetration distance is 50 feet at a velocity of 1800 fps. Increasing the velocity to 2150 fps raises the penetration distance to 60 feet. To create a path between two boreholes 100 feet apart, a penetrator can be emplaced in each hole and fired to meet in the center. Considering, as another example, a formation having an index of penetrability of 5 or greater a distance of 100 feet can be achieved at 2150 fps.

Figure 4:
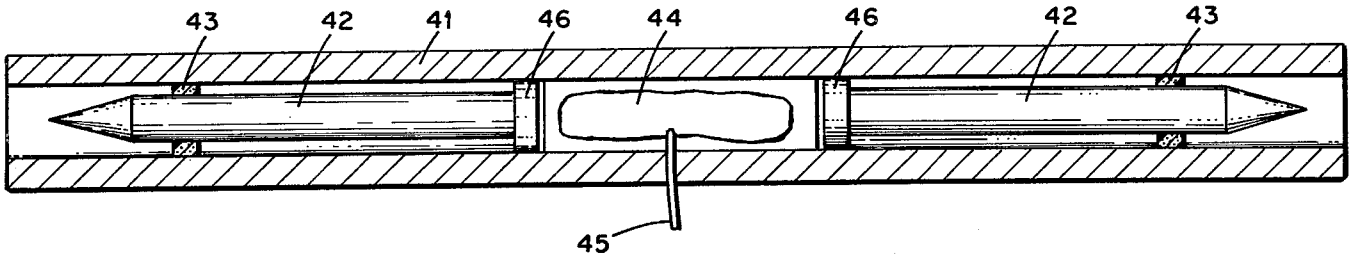
FIG. 4 is a cross section of a device suitable for delivering two earth penetrating projectiles in opposite directions for use in a specific embodiment of the present invention.

In a specific embodiment of the invention, a type of recoilless gun called a "Davis Gun", shown in FIG. 4, is used to fire two projectiles simultaneously in opposite directions. This is particularly advantageous for use in a coal gasification array since both penetrators are used constructively by interconnecting a series of vertical shafts. Referring to FIG. 4, there is shown a gun tube 41 with two oppositely directed projectiles 42 backed by pusher plates 46. The pusher plates are positioned so as to provide a space therebetween for placement of a suitable propellant 44 and attached detonator cable 45. The projectiles are retained in the launch position by foam rings 43. Typical specifications for achieving a velocity of about 2000 fps are: length of gun tube — 96 inches, inside diameter — 5 inches, outside diameter — 8 inches, material — 4340 steel, working peak pressure — 90 ksi, penetrator weight — 60 pounds, pusher place weight — 10 pounds, distance between pusher plates — 24 inches, propellant — 20 pounds of M30 (a commercially available propellant) with a web size of 0.042 inches. A faster burning propellant can be selected to give the desired velocity without using 24 inches of barrel length or initial spacing. In operation, the gun is emplaced, as by the method shown in FIG. 2, in a vertical borehole located between and adjacent to two other vertical boreholes. The two projectiles are then simultaneously fired in opposite directions to create a path interconnecting the three boreholes.

It can be seen from the above description that the process of the present invention provides a method for linking boreholes in a subterranean formation with a high permeability flow path the direction of which can be readily selected and controlled.

The foregoing description of the invention is explanatory only and changes in the method described may be made by those skilled in the art, within the scope of the appended claims, without departing from the spirit of the invention.

What I claim is:

1. A method for establishing a high permeability flow path from a first borehole to a second borehole adjacent thereto in a subterranean formation which method comprises:

emplacing in the first borehole at a preselected depth a means for rapid penetration of terrestrial materials including an earth penetrating projectile and a means for delivering said projectile into the subterranean formation at an impact velocity sufficient for rapid penetration of subterranean materials;

orienting said means within the first borehole so as to enable rapid penetration of the subterranean formation by said earth penetrating projectile substantially along a preselected path from the first borehole to the second borehole; and causing rapid penetration of the subterranean formation by said earth penetrating projectile, thereby establishing a high permeability flow path from the first borehole to the second borehole.

2. A method according to claim 1 wherein the subterranean formation is a coal formation.

3. A method according to claim 1 wherein the impact velocity is at least about 1000 feet per second.

4. A method according to claim 3 wherein the impact velocity is in the range of from about 1000 to about 2200 feet per second.

5. a method according to claim 1 wherein the first and the second boreholes extend vertically into the subterranean formation and the preselected path is generally horizontal.

6. A method for establishing a high permeability flow path substantially interconnecting a series of boreholes in a subterranean formation which comprises:

emplacing in an intermediate borehole in the series at a preselected depth a means for rapid penetration of terrestrial materials comprising two earth penetrating projectiles and a means for simultaneously delivering said projectiles in opposite directions at an impact velocity sufficient for rapid penetration of subterranean materials;

orienting said rapid penetration means within the intermediate borehole so as to cause rapid penetration of the subterranean formation by said earth penetrating projectiles substantially along a preselected path interconnecting the intermediate borehole with a first and a second borehole on either side thereof; and causing rapid penetration of the subterranean formation by simultaneous delivery of said projectiles, thereby establishing a high permeability flow path substantially interconnecting the series of boreholes.

* * * * *